US008570267B2

(12) United States Patent
Ohtsubo

(10) Patent No.: US 8,570,267 B2
(45) Date of Patent: Oct. 29, 2013

(54) DISPLAY APPARATUS AND METHOD FOR DRIVING SAME

(75) Inventor: Tomokazu Ohtsubo, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 839 days.

(21) Appl. No.: 12/733,566

(22) PCT Filed: Sep. 9, 2008

(86) PCT No.: PCT/JP2008/066208

§ 371 (c)(1),
(2), (4) Date: Mar. 9, 2010

(87) PCT Pub. No.: WO2009/044607

PCT Pub. Date: Apr. 9, 2009

(65) Prior Publication Data

US 2010/0194735 A1 Aug. 5, 2010

(30) Foreign Application Priority Data

Oct. 4, 2007 (JP) ..... 2007-261415

(51) Int. Cl.
*G09G 3/36* (2006.01)

(52) U.S. Cl.
USPC ..... 345/99; 345/100; 345/204; 377/64

(58) Field of Classification Search
USPC ..... 345/204–206, 208–211, 87, 90, 92, 94, 345/95, 98–100; 377/64–81
See application file for complete search history.

(56) References Cited

U.S. PATENT DOCUMENTS

| | | | | |
|---|---|---|---|---|
| 6,359,607 | B1 | 3/2002 | Yanagi et al. | |
| 7,432,901 | B2 * | 10/2008 | Baek et al. | 345/96 |
| 2001/0017611 | A1 * | 8/2001 | Moriyama | 345/100 |
| 2003/0160751 | A1 * | 8/2003 | Kudo et al. | 345/89 |
| 2004/0164976 | A1 * | 8/2004 | Nakamura et al. | 345/204 |
| 2004/0227711 | A1 * | 11/2004 | Kudo et al. | 345/87 |
| 2005/0052439 | A1 | 3/2005 | Liou | |

(Continued)

FOREIGN PATENT DOCUMENTS

| | | |
|---|---|---|
| JP | 05-080714 | 4/1993 |
| JP | 11-102172 | 4/1999 |

(Continued)

OTHER PUBLICATIONS

International Search Report, Dec. 2008.

*Primary Examiner* — Tom Sheng
(74) *Attorney, Agent, or Firm* — Harness, Dickey & Pierce

(57) ABSTRACT

In one embodiment of the present invention, an active matrix display apparatus includes a screen having a plurality of regions each provided with a gate driver, in each of which plurality of regions scanning lines are driven so as to be sequentially selected by use of timing of a gate clock signal supplied to the gate driver, wherein corresponding ones of the gate clock signals for some of the plurality of regions have respective different pulse widths. Thus, it is possible to realize a display apparatus including a screen having a plurality of regions, in which display apparatus a difference in brightness between ones of some of the plurality of regions can be prevented.

6 Claims, 8 Drawing Sheets

(56) References Cited

U.S. PATENT DOCUMENTS

| | | | | |
|---|---|---|---|---|
| 2005/0062706 | A1* | 3/2005 | Mizumaki | 345/94 |
| 2006/0187165 | A1* | 8/2006 | Ono et al. | 345/94 |
| 2006/0227095 | A1* | 10/2006 | Kim et al. | 345/100 |
| 2006/0284815 | A1* | 12/2006 | Kwon et al. | 345/98 |
| 2007/0040795 | A1 | 2/2007 | Lee et al. | |
| 2007/0159441 | A1* | 7/2007 | Yang et al. | 345/99 |
| 2007/0182688 | A1* | 8/2007 | Jang | 345/98 |
| 2009/0295784 | A1 | 12/2009 | Kwon et al. | |

FOREIGN PATENT DOCUMENTS

| | | |
|---|---|---|
| JP | 2000-180822 | 6/2000 |
| JP | 2005-070722 | 3/2005 |
| JP | 2005-091781 | 4/2005 |
| JP | 2006-350289 | 12/2006 |
| JP | 2007-058211 | 3/2007 |
| JP | 2007-102132 | 4/2007 |

* cited by examiner

DISPLAY APPARATUS AND METHOD FOR DRIVING SAME

TECHNICAL FIELD

The present invention relates to (i) a display apparatus including a screen having a plurality of regions each of which is independently driven, and to (ii) a method for driving the display apparatus.

BACKGROUND ART

In a display apparatus (e.g., liquid crystal display apparatus) for performing display high in definition, a time allocated for writing data into pixels is reduced. In a display apparatus increased in size, a waveform of a signal is rounded. In view of such circumstances, there is proposed a configuration in which a display section has a plurality of regions each to be independently driven (see, for example, Patent Literatures 1 through 5).

Patent Literature 1 discloses a display apparatus in which a display section has (i) a first region including a plurality of source lines (HS1 through HSm) and a plurality of gate lines (G1 through G(n/2)) and (ii) a second region including a plurality of source lines (HS1' through HSm') and a plurality of gate lines (G(n/2+1) through Gn), wherein the first region is driven by a source driver 2 and a gate driver 3, and the second region is driven by a source driver 2' and a gate driver 3' (see FIG. 8).

Patent Literature 1

Japanese Patent Application Publication, Tokukaihei, No. 11-102172 A (Publication Date: Apr. 13, 1999)

Patent Literature 2

Japanese Patent Application Publication, Tokukai, No. 2005-70722 A (Publication Date: Mar. 17, 2005)

Patent Literature 3

Japanese Patent Application Publication, Tokukai, No. 2005-91781 A (Publication Date: Apr. 7, 2005)

Patent Literature 4

Japanese Patent Application Publication, Tokukai, No. 2000-180822 A (Publication Date: Jun. 30, 2000)

Patent Literature 5

Japanese Patent Application Publication, Tokukaihei, No. 5-80714 A (Publication Date: Apr. 2, 1993)

SUMMARY OF INVENTION

In a configuration in which a screen has, as described earlier, a plurality of regions, resistance and capacitance on a bus line (such as a gate bus line and a source bus line) may be varied from a bus line provided in one of the plurality of regions to a bus line provided in another of the plurality of regions due to the difference in conditions under which these ones of the plurality of regions are formed. Further, resistance and capacitance of a member (such as a TFT, a liquid crystal capacitor, a storage capacitor, and a parasitic capacitor for constituting a pixel) connected to a bus line may be varied from a member provided in one of the plurality of regions to a member provided in another of the plurality of regions. Moreover, a degree of signal delay may be varied from a signal supplied to one of the plurality of regions to a signal supplied to another of the plurality of regions, due to a factor such as a difference in alignment of signal lines among the plurality of regions.

Accordingly, even when the plurality of regions is driven so as to display a same gray scale value, a brightness in a pixel may be varied among the plurality of regions. An inventor of the present application found the following risk in relation with this. Specifically, in the case as described above, if the plurality of regions is driven in a same way, a difference in brightness among the plurality of regions may become noticeable enough for a viewer to recognize boundaries of the plurality of regions. Consequently, deterioration in display quality is caused.

The present invention is made in view of the problem, and an object of the present invention is to realize (i) a display apparatus including a screen having a plurality of regions, in which display apparatus a difference in brightness among the plurality of regions can be prevented, and (ii) a method for driving the display apparatus.

In order to attain the object, a display apparatus of the present invention is configured to so as to be an active matrix display apparatus, comprising a screen having a plurality of regions each provided with a gate driver, in each of which plurality of regions scanning lines are driven so as to be sequentially selected by use of timing of a gate clock signal individually supplied to the gate driver, wherein: corresponding ones of the gate clock signals for some of the plurality of regions have respective different pulse widths.

According to the invention, some of the plurality of regions, which are supplied with the corresponding ones of the gate clock signals having respective different pulse widths, are supplied with scanning signals that are generated with the use of timing of gate clock signals and are thereby different from each other in terms of pulse periods. Thus, an electrical charging rate of a pixel can be varied between a pixel of one of some of the plurality of regions and a pixel of another of some of the plurality of regions. Therefore, even if these ones of some of the plurality of regions are formed under different conditions, a brightness in the pixel of one of some of the plurality of regions can be set to the same brightness level as the pixel of another of some of the plurality of regions.

Thus, it is possible to realize a display apparatus including a screen having a plurality of regions, in which display apparatus a difference in brightness between ones of some of the plurality of regions can be prevented.

In order to attain the object, the display apparatus of the present invention is configured such that the corresponding ones of the gate clock signals are identical in terms of pulse-end timing or pulse-start timing.

With the invention, it is possible to easily set a pulse period of a scanning signal as a period of a gate clock signal between pulse-end timing of a pulse and pulse-start timing of a following pulse.

In order to attain the object, the display apparatus of the present invention is configured such that the gate driver generates a scanning signal so that the scanning signal has a same period between pulse-start timing and pulse-end timing as a period of the gate clock signal between pulse-end timing of a pulse and pulse-start timing of a following pulse.

With the invention, it is possible to easily create a pulse of a scanning signal by use of an interval between two successive pulses of the gate clock signal.

In order to attain the object, a display apparatus of the present invention is an active matrix display apparatus, comprising a screen having a plurality of regions each provided with a gate driver, in each of which plurality of regions scanning lines are driven so as to be sequentially selected by use of a scanning signal supplied from the gate driver, wherein corresponding ones of the scanning signals for some of the plurality of regions have respective different pulse widths.

By the invention, an electrical charging rate of a pixel can be varied between pixels of respective ones of some of the plurality of regions that are supplied with the corresponding ones of the scanning signals having the respective different pulse widths. Thus, even in a case where one the respective ones of some of the plurality of regions are formed under different conditions, it is possible to set brightness in the pixels of respective ones of some of the plurality of regions to the same brightness levels.

Thus, it is possible to realize a display apparatus including a screen having a plurality of regions, in which display apparatus a difference in brightness between ones of some of the plurality of regions can be prevented.

In order to attain the object, the display apparatus of the present invention is configured such that the scanning signal has a pulse which ends after a slope period during which the scanning signal changes, with a slope, towards a pulse-end voltage level.

As such, a waveform of each scanning signal can be remain the same throughout a scanning signal line, regardless of a factor causing a signal delay distribution on the scanning signal line which is varied from one point on the scanning line to another point on the scanning line. The signal delay distribution on a scanning signal line is particularly problematic to a display apparatus with a large screen often having a plurality of regions. To such display apparatus, an effect that prevents a difference in brightness between ones of the plurality of regions by varying pulse periods of respective corresponding scanning signals can be more effective.

In order to attain the object, the display apparatus of the present invention is configured such that the scanning signal has a voltage level, at an end of the slope period, which causes a selection apparatus in a pixel of the active matrix display apparatus to be turned ON.

By the invention, each pixel can be electrically charged until an end of the slope period. As such, it is possible, with allocation of a sufficient time for electrically charging pixels, to vary a pulse period of a scanning signal between a scanning signal supplied to one of the plurality of regions and a scanning signal supplied to another of the plurality of regions.

In order to attain the object, a display apparatus of the present invention is an active matrix display apparatus, comprising a screen having a plurality of regions each provided with a gate driver, in each of which plurality of regions scanning lines are driven so as to be sequentially selected by use of a scanning signal supplied from the gate driver, wherein: some of the scanning signals have pulse waveforms which end after respective slope periods during which the scanning signals change, with respective different slopes, towards respective pulse-end voltage levels.

By the invention, a conductance of a selection apparatus in a pixel during a slope period can be varied between a selection apparatus in a pixel of a region supplied with one of some of the scanning signals and a selection apparatus in a pixel of a region supplied with another of some of the scanning signals. As such, an electrical charging rate of a pixel can be varied between the pixels of regions supplied with respective ones of some of the scanning signals. Thus, even if these regions are formed under different conditions, it is possible to set brightness in the pixels of these regions to the same brightness levels.

Thus, it is possible to realize a display apparatus including a screen having a plurality of regions, in which display apparatus a difference in brightness between ones of the plurality of regions can be prevented.

In order to attain the object, the display apparatus of the present invention is configured such that each of the scanning signals has a voltage level, at an end of the slope period, which causes a selection apparatus in a pixel of the active matrix display apparatus to be turned ON.

By the above invention, each pixel can be electrically charged until an end of the slope period. As such, it is possible, with allocation of a sufficient time for electrically charging pixels, to vary a conductance of a selection apparatus in a pixel between selection apparatuses in pixels of respective ones of the plurality of regions.

In order to attain the object, the display apparatus of the present invention is configured such that the scanning signals, other than at least one of the scanning signals which changes with a smallest slope during the slope period, reach a voltage level that causes the selection apparatus in the pixel of the active matrix display apparatus to be turned OFF.

By the above invention, lengths of the time during which pixels are electrically charged are determined, based on sizes of the respective slopes with which the scanning signals decline during the respective slope periods. Thus, it is possible to set an electrical charging rate of a pixel of the one of the plurality of regions to the same electrical charging rate as that of a pixel of another of the plurality of regions.

In order to attain the object, the display apparatus of the present invention is configured such that charge sharing between data signal lines is carried out during a horizontal blanking period.

According to the invention, since charge sharing is carried out, a pixel can be quickly charged from one polar character to the other when being operated by AC driving. Thus, it is possible to allocate a sufficient time for electrically charging pixels.

In order to attain the object, a method according to the present invention for driving a display apparatus is a method for driving an active matrix display apparatus including a screen having a plurality of regions each provided with a gate driver, in each of which plurality of regions scanning lines are driven so as to be sequentially selected by use of timing of a gate clock signal individually supplied to the gate driver, wherein: the scanning lines are driven in each of the plurality of regions so that corresponding ones of the gate clock signals for some of the plurality of regions have different pulse widths.

According to the invention, some of the plurality of regions, which are supplied with the corresponding ones of the gate clock signals having the different pulse widths, are supplied with corresponding scanning signals that are generated with the use of timings of the corresponding gate clock signals and thereby different from each other in terms of different pulse period. Accordingly, a charging rate of a pixel can be varied from a pixel of one of some of the plurality of regions and a pixel of another of some of the plurality of regions. Thus, even if some of the plurality of regions are formed under different conditions, it is possible to set a brightness in the pixel of one of some of the plurality of regions to the same brightness level as the pixel of another of some of the plurality of regions.

Thus, it is possible to realize a method for driving a display apparatus including a screen having a plurality of regions, by which method a difference in brightness between ones of some of the plurality of regions can be prevented.

In order to attain the object, the method according to the present invention is arranged such that the corresponding ones of the gate clock signals are identical in terms of pulse-end timing or pulse-start timing.

With the above invention, it is possible to easily define a pulse period of each scanning signal as a period of a corresponding gate clock signal between pulse-end timing of a pulse and pulse-start timing of a following pulse.

In order to attain the object, the method according to the present invention is arranged such that the gate driver generates a scanning signal so that the scanning signal has a same period between pulse-start timing and pulse-end timing as a period of the gate clock signal between pulse-end timing and pulse-start timing.

With the invention, it is possible to easily generate a pulse of each scanning signal by using an interval between two successive pulses of a corresponding gate clock signal.

In order to attain the object, the method according to the present invention is a method for driving an active matrix display apparatus including a screen having a plurality of regions each provided with the gate driver, in each of which plurality of regions scanning lines are driven so as to be sequentially selected by use of a scanning signal supplied from a gate driver, wherein: corresponding ones of the scanning signals for some of the plurality of regions have respective different pulse widths.

By the invention, a charging rate of a pixel can be varied between pixels of respective ones of some of the plurality of regions supplied with the corresponding ones of the scanning signals. Thus, even if some of the plurality of regions are formed under different conditions, it is possible to set a brightness in a pixel of one of some of the plurality of regions to the same brightness level as a pixel of another of some of the plurality of regions.

Thus, it is possible to realize a method for driving a display apparatus including a screen having a plurality of regions, by which method a difference in brightness between ones of some of the plurality of regions can be prevented.

In order to attain the object, the method according to the present invention is arranged such that the scanning signal has a pulse which ends after a slope period during which the scanning signal changes, with a slope, towards a pulse-end voltage level.

According to the invention, a pulse of each scanning line has a slope period. As such, a waveform of each scanning signal can remains the same throughout a scanning signal line, regardless of a factor causing signal delay distribution on the scanning signal line which is varied from one point on the scanning signal line to another point on the scanning signal line. The signal delay distribution on the scanning signal line is particularly problematic to a display apparatus with a large screen often having a plurality of regions. To such display apparatus, an effect that prevents a difference in brightness between ones of the plurality of regions by varying pulse periods of corresponding scanning signals can be more effective.

In order to attain the object, the method according to the present invention is arranged such that the scanning signal has a voltage level, at an end of the slope period, which causes a selection apparatus in a pixel of the active matrix display apparatus to be turned ON.

By the above invention, each pulse can be charged until an end of the pulse period. Thus, it is possible, on allocation of a sufficient time for electrically charging pixels, to vary a pulse period of a scanning signal between a scanning signal supplied to one of the plurality of regions and another scanning signal supplied to another of the plurality of regions.

In order to attain the object, a method according to the present invention for driving a display apparatus is a method for driving a display apparatus including a screen having a plurality of regions each provided with the gate driver, in each of which plurality of regions scanning lines are driven so as to be sequentially selected by use of a scanning signal supplied from a gate driver, wherein: some of the scanning signals have pulse waveforms which end after respective slope periods during which the scanning signals change, with respective different slopes, towards respective pulse-end voltage levels.

According to the above invention, a conductance of a selection apparatus in a pixel during a slope period can be varied between selection apparatuses in pixels of respective ones of the plurality of regions which are supplied with some of the scanning signals changing with respective different slopes during the respective pulse periods. As such, an electrical charging rate of a pixel can be varied between pixels of ones of the plurality of regions. Thus, even if the ones of the plurality of regions are formed under different conditions, it is possible to set brightness in the pixels of ones of the plurality of regions to the same brightness levels.

Thus, it is possible to realize a method for driving a display apparatus including a screen having a plurality of regions, by which method a difference in brightness between ones of the plurality of regions can be prevented.

In order to attain the object, the method according to the present invention is arranged such that each of the scanning signals has a voltage level, at an end of the slope period, which causes a selection apparatus in a pixel of the active matrix display apparatus to be turned ON.

By the invention, each pixel can be electrically charged until an end of a slope period. As such, it is possible, on allocation of a sufficient time for electrically charging pixels, to vary a conductance of a selection apparatus between selection apparatuses in pixels of ones of the plurality of regions.

In order to attain the object, the method according to the present invention is arranged such that the scanning signals, other than at least one of the scanning signals which changes with a smallest slope during the slope period, reach a voltage level that causes the selection apparatus in the pixel of the active matrix display apparatus to be turned OFF.

By the invention, a length of a time during which a pixel is electrically charged can be determined in accordance with a difference in sizes of the respective slopes with which the scanning signals change during the respective slope periods. Thus, it is possible to easily set an electrical charging rate of a pixel of one of the plurality of regions to the same electrical charging level as a pixel of another of the plurality of regions.

In order to attain the object, the method according to the present invention is arranged such that charge sharing between data signal lines is carried out during a horizontal blanking period.

According to the above invention, since charge sharing is carried out, a pixel can be electrically charged quickly from one polar character to the other when being driven by AC driving. Thus it is possible to allocate a sufficient time for electrically charging a pixel.

For a fuller understanding of the nature and advantages of the invention, reference should be made to the ensuing detailed description taken in conjunction with the accompanying drawings.

BRIEF DESCRIPTION OF REFERENCE NUMERALS

1. Liquid crystal display apparatus (display apparatus)
10. Display section (screen)
10*a*. Upper region (region)
10*b*. Lower region (region)
3*a*. Upper source driver
4*a*. Lower source driver
5*a*. Upper gate driver (gate driver)
6*a*. Lower gate driver (gate driver)
VG1. Scanning signal
VG2. Scanning signal
GCK1. Gate clock signal
GCK2. Gate clock signal
Tslope. Slope period

DESCRIPTION OF EMBODIMENTS

One embodiment of the present invention is described as below, with reference to FIGS. 1 through 7.

Figure 2:
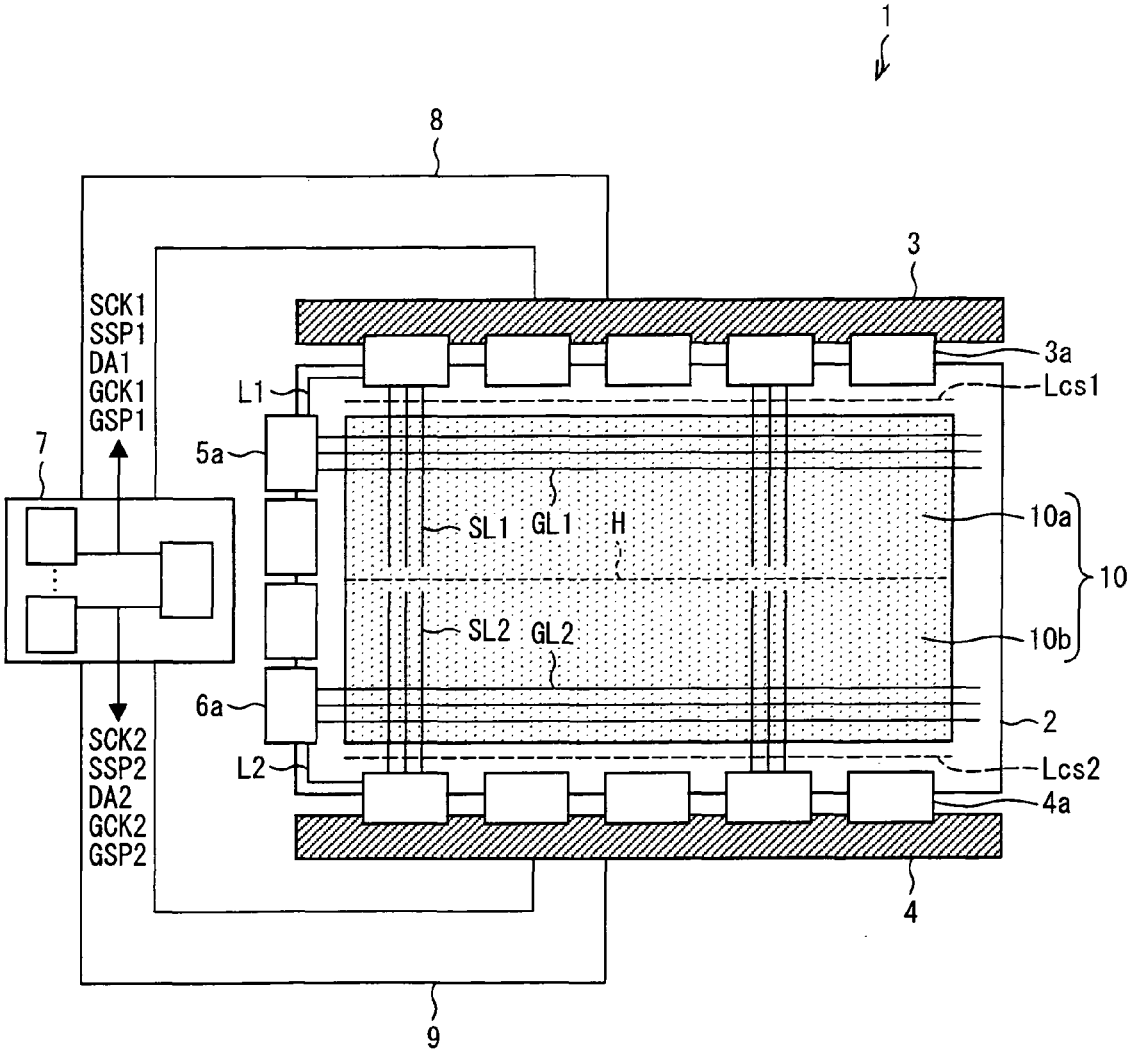
FIG. 2 is a block diagram showing a configuration of the display apparatus in accordance with the embodiment of the present invention.

FIG. 2 shows a configuration of a liquid crystal display apparatus (display apparatus) 1 in accordance with the present embodiment.

The liquid crystal display apparatus 1 includes an active matrix display panel. The active matrix display panel includes a panel substrate 2, an upper source substrate 3, a lower source substrate 4, a plurality of upper source drivers 3*a*, a plurality of lower source drivers 4*a*, a plurality of upper gate drivers 5*a*, a plurality of lower gate drivers 6*a*, a control substrate 7, and input cables 8 and 9.

According to the panel substrate 2, a liquid crystal layer is sandwiched between a TFT substrate and a counter substrate so that a display section 10 is formed in the panel substrate 2. The display section 10 is a region into which pixels are formed. The display region 10 includes two regions (i.e., an upper region 10*a* and a lower region 10*b*) whose border is defined by a boundary H. The plurality of upper source drivers 3*a* and the plurality of source drivers 4*a* are provided oppositely to each other in respective sides of the display region 10. Each upper source driver 3*a* is mounted on the panel substrate 2 by use of SOF (System on Film) so as to have one end part connected to an upper end part of the panel substrate 2. Each lower source driver 4*a* is mounted on the panel substrate 2 by use of SOF so as to have one end part connected to a lower end part of the panel substrate 2. The upper source driver 3*a* has an opposite end part connected to the upper source substrate 3, and the source driver 4*a* has an opposite end part connected to the lower source substrate 4.

The upper source substrate 3 receives signals that are supplied from the control substrate 7 via the input cable 8. The lower source substrate 4 receives signals that are supplied from the control substrate 7 via the input cable 9.

Each upper gate driver 5*a* is mounted on the panel substrate 2 by use of SOF so as to have one end part connected to the panel substrate 2. Each lower gate driver 6*a* is mounted on the panel substrate 2 by use of SOF so as to have one end part connected to the panel substrate 2. No gate substrate is employed, and lines L1 extending from the control substrate 7 to the upper gate driver 5*a* are routed around on the panel substrate 2 via the upper source driver 3*a*, whereas lines L2 extending from the control substrate 7 to the lower gate driver 6*a* are routed around on the panel substrate 2 via the lower source driver 4*a*.

The upper source driver 3*a* includes data signal output terminals to which data signal lines SL 1 are connected. The data signal lines SL 1 are provided in the upper region 10*a* so as to extend orthogonally to the boundary line H. The source driver 4*a* includes data signal output terminals to which data signal lines SL 2 are connected. The data signal lines SL 2 are provided in the lower region 10*b* so as to extend orthogonally to the boundary line H. Note that for convenience, only some data signal lines SL1 and some data signal lines SL2 are illustrated in FIG. 2.

The upper gate driver 5*a* includes gate signal output terminals to which scanning signal lines GL1 are connected. The scanning signal lines GL 1 are provided in the upper region 10*a* so as to extend in parallel with boundary line H. The lower gate driver 6*a* includes gate signal output terminals to which scanning signal lines GL2 are connected. The scanning signal lines GL 2 are provided in the lower region 10*b* so as to extend in parallel with the boundary line H. Note that for convenience, only some scanning signal lines GL1 and some scanning signal lines GL2 are illustrated in FIG. 2.

According to the above configuration, the upper region 10*a* is driven by the upper source drivers 3*a* and the upper gate drivers 5*a*, and the lower region 10*b* is driven by the lower source drivers 4*a* and the lower gate drivers 6*a*.

Storage capacitor lines (not shown in FIG. 2) are also provided so as to extend in a direction in which the scanning signal lines GL1 and the scanning signal lines GL2 are provided. The storage capacitor lines provided in the upper region 10*a* are routed around from the upper source substrate 3, and the storage capacitor lines provided in the lower region 10*b* are routed around from the lower source substrate 4.

The control substrate 7 is a substrate including one or more ASIC for carrying out processing such as (i) CPU control, (ii) a variety of image processing, (iii) conversion of scanning mode required in a case of a television display panel, and (iv) generation of timing signals. The control substrate 7 generates the following signals as the timing signals: (i) a source clock signal SCK1 and a source start pulse SSP1, each of which is supplied to an upper source driver 3*a*, (ii) a source clock signal SCK2 and a source start pulse SSP2, each of which is supplied to an lower source driver 4*a*, (iii) a gate clock signal GCK1 and a gate start pulse GSP1, each of which is supplied to an upper gate driver 5*a*, and (iv) a gate clock signal GCK2 and a gate start pulse GSP2, each of which is supplied to a lower gate driver 6*a*. The control substrate 7 receives, and then converts image data DA so that the image data DA has a given number of bits, which are (a) supplied, as image data DA1, to an upper source driver 3*a*, and (b) supplied, as image data DA2, to an lower source driver 4*a*.

On the panel substrate 2, a line Lcs 1 is provided between the upper region 10*a* and the upper source drivers 3*a*, and a line Lcs 2 is provided between the lower region 10*b* and the lower source drivers 4*a*. Each of the lines Lcs 1 and Lcs 2 is provided so as to extend in a direction in which scanning signal lines GL extend. In the liquid crystal display apparatus which employs, for example, dot inversion driving, an operation so-called charge sharing is carried out during each horizontal blanking period. According to the charge sharing, (i) the data signal lines SL 1 are connected to one another via the line Lcs 1 so that electrical charges on the data signal lines SL 1 are cancelled out, and (ii) the data signal lines SL 2 are connected to one another via the line Lcs 2 so that electrical charges on the data signal lines SL 2 are cancelled out. An end of the line Lcs 1 and that of the line Lcs 2 may be supplied with a common voltage Vcom, so that the charge sharing is carried out.

Figure 3:
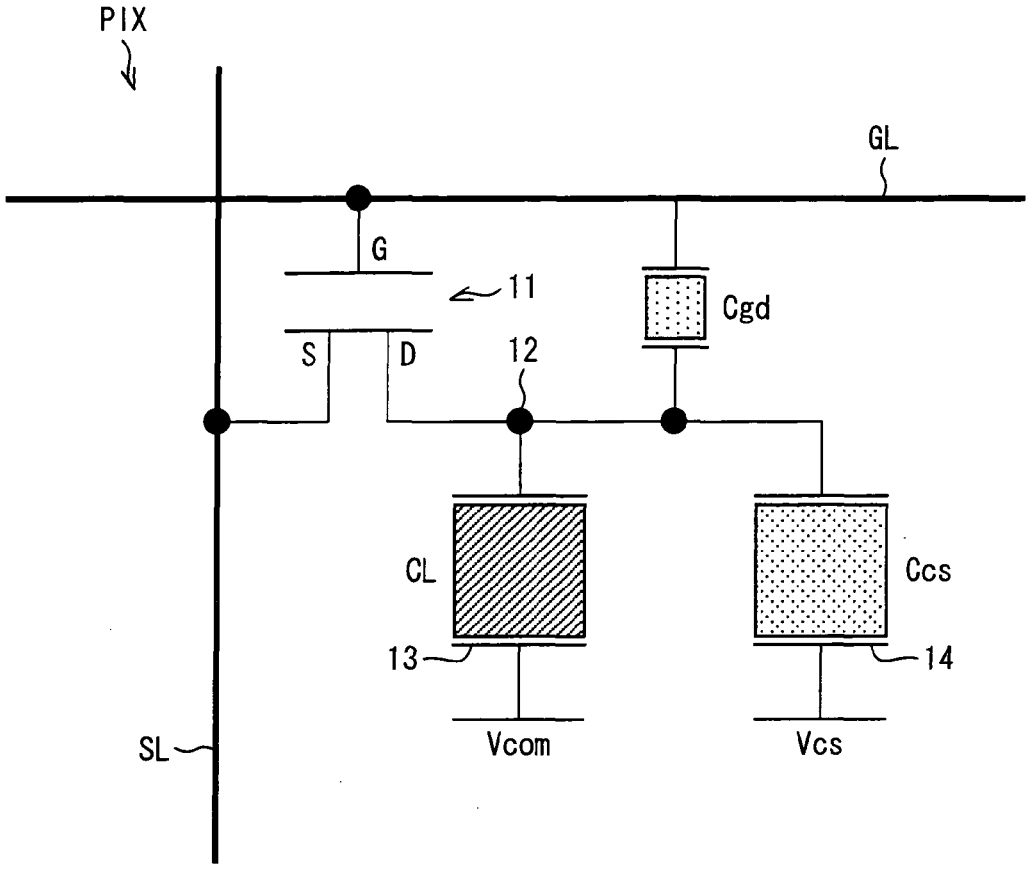
FIG. 3 is a circuit diagram showing an equivalent circuit of a pixel of the display apparatus shown in FIG. 2.

FIG. 3 shows a configuration of a pixel PIX of the liquid crystal display apparatus 1. A pixel PIX of the upper region 10*a* has the same configuration as that of the lower region 10*b*.

A pixel PIX is provided for a corresponding one of intersections of the scanning signal lines GL and the data signal lines SL. The pixel PIX includes a TFT 11, and has a liquid crystal capacitance CL and a storage capacitance Ccs. The TFT 11 has a gate (G) connected to a scanning signal line GL, a source (S) connected to a data signal line SL, and a drain (D) connected to a pixel electrode 12. The liquid crystal capacitance CL is formed and defined by the pixel electrode 12 and a counter electrode to which a common voltage Vcom is kept to be applied. The storage capacitance Ccs is formed and defined by the pixel electrode 12 and an electrode 14 to which a storage capacitance voltage Vcs is applied via a storage capacitance line. The storage capacitance voltage Vcs can be of the same voltage level as the common voltage Vcom. In the pixel PIX, parasitic capacitance Cgd is formed and defined by the pixel electrode 12 and a scanning signal line GL.

The TFT 11 is a three-terminal device that serves as an active device in an active matrix pixel. The TFT 11 is turned ON while the gate of the TFT 11 is receiving, via the scanning line GL, a signal that causes the pixel PIX to be selected. The TFT 11 is tuned OFF while the gate of the TFT 11 is receiving, via the scanning signal line GL, a signal that causes the pixel PIX not to be selected. While the TFT 11 is being turned ON, a data signal is supplied to the pixel PIX from the data signal line SL, via the source of and the drain of the TFT 11. While the TFT 11 is being turned OFF, the pixel PIX is maintained in a state in which the pixel PIX holds the data signal which was previously supplied and written into the pixel PIX while the pixel PIX was being selected.

The following description discusses a method according to the present embodiment for driving the liquid crystal display apparatus.

An illumination inspection of a liquid crystal display panel is carried out during producing of the liquid crystal display apparatus 1. While the illumination inspection is being carried out, the control substrate 7 causes its timing controller to generate signals at timing which is set externally. For example, the control substrate 7 causes the timing controller to generate each of the gate clock signals GCK 1 and GCK 2 in accordance with a clock cycle and a clock pulse width which are externally set by use of software.

During the illumination inspection of the liquid crystal display panel, panel display is carried out by use of the gate clock signals GCK 1 and GCK 2 which are generated in accordance with initially set clock cycle and clock pulse width. Then, in a case where a brightness of the upper region 10*a* and a brightness of the lower region 10*b* differ from each other due to the difference in condition under which the upper region 10*a* and the lower region 10*b* are formed, the following processes are carried out.

In the present embodiment, for example, it is assumed in the illumination inspection that the brightness of the upper region 10*a* is lower than that of the lower region 10*b*.

Figure 1:
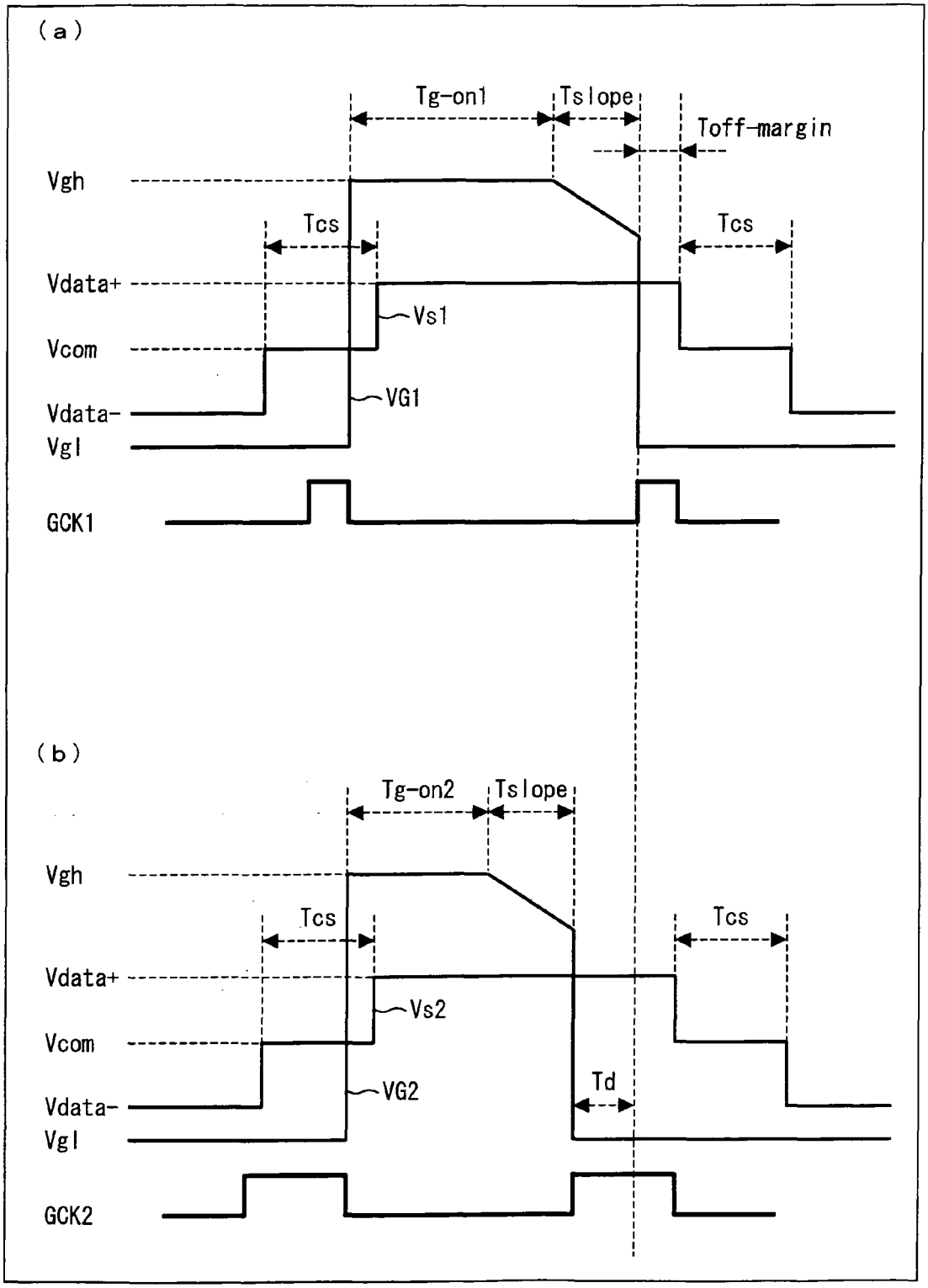
FIGS. 1 (*a*) and (*b*) of FIG. 1 are waveform charts each showing waveforms of voltages in a display apparatus in accordance with an embodiment of the present invention.

(*a*) of FIG. 1 shows waveforms of (i) the gate clock signal GCK 1, (ii) the scanning signal VG 1, and (iii) the data signal Vs 1, each of which signals (i) through (iii) is supplied to the upper region 10*a*. (*b*) of FIG. 1 shows waveforms of (i) the gate clock signal GCK 2, (ii) the scanning signal VG 2, and (iii) the data signal Vs 2, each of which signals (i) through (iii) is supplied to the lower region 10*b*.

A waveform of the gate clock signal GCK 1 shown in (*a*) of FIG. 1 occurs during the illumination inspection of the liquid crystal display panel. A waveform of the gate clock signal GCK 2 shown in (*b*) of FIG. 1 is of a signal generated by taking into consideration a result of the illumination inspection of the liquid crystal display panel. Note that the gate clock signal GCK 2 is a signal generated by externally rewriting and setting a clock pulse width into the control substrate 7 without changing the clock cycle, so that the gate clock signal GCK 2 is greater in clock pulse width than the gate clock signal GCK 1. The following measures are taken such that the gate clock signal GCK 2 has a greater clock pulse width than the gate clock signal GCK 1. Specifically, the gate clock signal GCK 2 has a pulse start-timing (which is, in this case, the timing at which a clock pulse rises) which comes earlier than the gate clock signal GCK 1, and a pulse end-timing (which is, in this case, a timing at which the clock pulse falls) which comes at the same timing as the gate clock signal GCK 1.

Each upper gate driver 5*a* generates a scanning signal VG 1 with use of the gate clock signal GCK 1 and the gate start pulse GSP 1 which are supplied from the control substrate 7. Each lower gate driver 6*a* generates the scanning signal VG 2 with use of the gate clock signal GCK 2 and the gate start pulse GSP 2 which are supplied from the control substrate 7. The scanning signal VG 1 is generated so as to (i) rise from a gate-low voltage Vgl to a gate-high voltage Vgh at a timing at which a clock pulse of the gate clock signal GCK 1 falls, and then (ii) fall to the gate-low voltage Vgl at a timing at which a following clock pulse of the gate clock signal rises. The scanning signal VG 2, similarly, is generated so as to (i) rise from a gate-low voltage Vgl to a gate-high voltage Vgh at a timing at which a clock pulse of the gate clock signal GCK 2 falls, and then (ii) fall to the gate-low voltage Vgl at a timing at which a following clock pulse of the gate clock signal GCK 2 rises. In (*a*) of FIG. 1, a period Tg-on 1 indicates a period during which the scanning signal VG 1 is the gate-high voltage Vgh. The period Tg-on 1 is followed by a slope period Tslope during which the scanning signal VG 1 declines, at a slope, from the gate-high voltage Vgh. In (*b*) of FIG. 1, a period Tg-on 2 (Tg-on 2<Tg-on 1) indicates a period during which the scanning signal VG 2 is the gate-high voltage Vgh. The period Tg-on 2 is followed by a slope period Tslope during which the scanning signal VG 2 declines, at a slope, from the gate-high voltage Vgh. The slopes of the respective slope periods Tslope are set such that voltages of the scanning signal VG 1 and VG 2 become, at ends of the respective slope periods Tslope, higher than a threshold voltage of the TFT 11. As such, the TFT 11 is turned ON at the ends of the respective slope period Tslope. Subsequently, the TFT 11 is turned OFF in process of the scanning signal VG 1 (the scanning signal VG 2) reducing to the gate-low voltage Vgl. Note that the slope periods Tslope are not necessarily provided. The slope periods Tslope are described later.

Since each timing of the gate clock signals GCK 1 and GCK 2 is thus set, the scanning signal VG 2 rises at the same timing as the scanning signal VG 1, and falls earlier than the scanning signal VG 1 only by a period Td. It follows that a period during which the pixel PIX is selected by the scanning signal VG 2 is shorter by the period Td than a period during which the pixel PIX is selected by the scanning signal VG 1.

The data signal Vs 1 is line-sequentially supplied to the data signal lines SL 1, and the data signal Vs 2 is line-sequentially supplied to the data signal lines SL 2. The data signals VS 1 and VS 2 can be in a range varying from a negative voltage Vdata− to a positive voltage Vdata+ and centered at a common voltage Vcom. According to the present embodiment, charge sharing is carried in which the data signal lines SL 1 and SL 2 are caused to have the common voltage Vcom during each horizontal blanking period. In each of (*a*) and (*b*) of FIG. 1, a period during which the charge sharing is carried out is indicated by a period Tcs. Both the data signals Vs 1 and Vs 2 require to be kept at a target voltage level at ends of the respective periods during which the pixels PIX are selected, in order that pixels PIX are electrically charged to the target voltage level by the respective data signals Vs 1 and Vs 2. In view of the circumstance, even in a case where the period during which the pixels PIX are selected is the longest as shown in (*a*) FIG. 1, the scanning signal VG 1 falls to the gate-low voltage Vgl earlier by a margin period Toff-margin than an end of a horizontal period during which the data signals Vs 1 and Vs 2 are written into the pixel PIX.

Since the gate clock signals GCK 1 and GCK 2 are thus set, charging rates of pixels PIX are determined, based on active periods of. Note that the active periods of corresponding scanning signals VG 1 and VG 2 are periods that determine the respective periods during which pixels are selected. That is, a difference between the charging rates of pixels are determined, based on a difference between a clock pulse width of the gate clock signal GCK 1 and a clock pulse width of the gate clock signal GCK 2. In the case with (*a*) and (*b*) of FIG. 1, the gate clock signal VG 2 is greater in clock pulse width than the gate clock signal GCK 1. Accordingly, an electrical charging rate of a pixel PIX of the lower region 10*b* is decreased. As such, a brightness in the pixel PIX of the lower region 10*b* is decreased in proportion to the decrease in the charging rate of a pixel PIX of the lower region 10*b*. By setting electrical charging rates of pixels PIX to appropriate ones, it is possible to set a brightness in a pixel PIX of the upper region 10*b* to the same brightness level as the pixel PIX of the lower region 10*b*.

The following description discusses the slope periods Tslope shown in (*a*) and (*b*) of FIG. 1. Generally, a scanning signal supplied via a scanning signal line is delayed due to line resistance distribution and line capacitance distribution on the scanning signal line, such that a waveform of the scanning signal is rounded by a greater degree as a distance between an output terminal of a gate driver and a destination to which the scanning signal is supplied becomes greater. As the scanning signal falls, a TFT in a pixel PIX is turned from ON to OFF. However, while the TFT in the pixel PIX is being turned from ON to OFF, a phenomenon so called feed-through is caused. By the feed-through, an electric potential of a pixel electrode is changed due to an influence provided via a parasitic capacitance Cgd shown in FIG. 3. Note that if a waveform of the scanning signal falls differently, depending on a destination to which the scanning signal is supplied, there is a variation in a degree by which an electrical potential of the pixel electrode is varied due to the feed-through. Thus, a brightness of a pixel PIX is varied depending on where the pixel PIX is provided. In this case, a falling part of a waveform of a scanning signal should be rounded to a sufficient degree in advance by the gate driver, so that the falling part of a waveform of a scanning signal remains the same throughout the scanning signal line. Thus, it is possible to set feed-through voltages to the same voltage levels.

Figure 4:
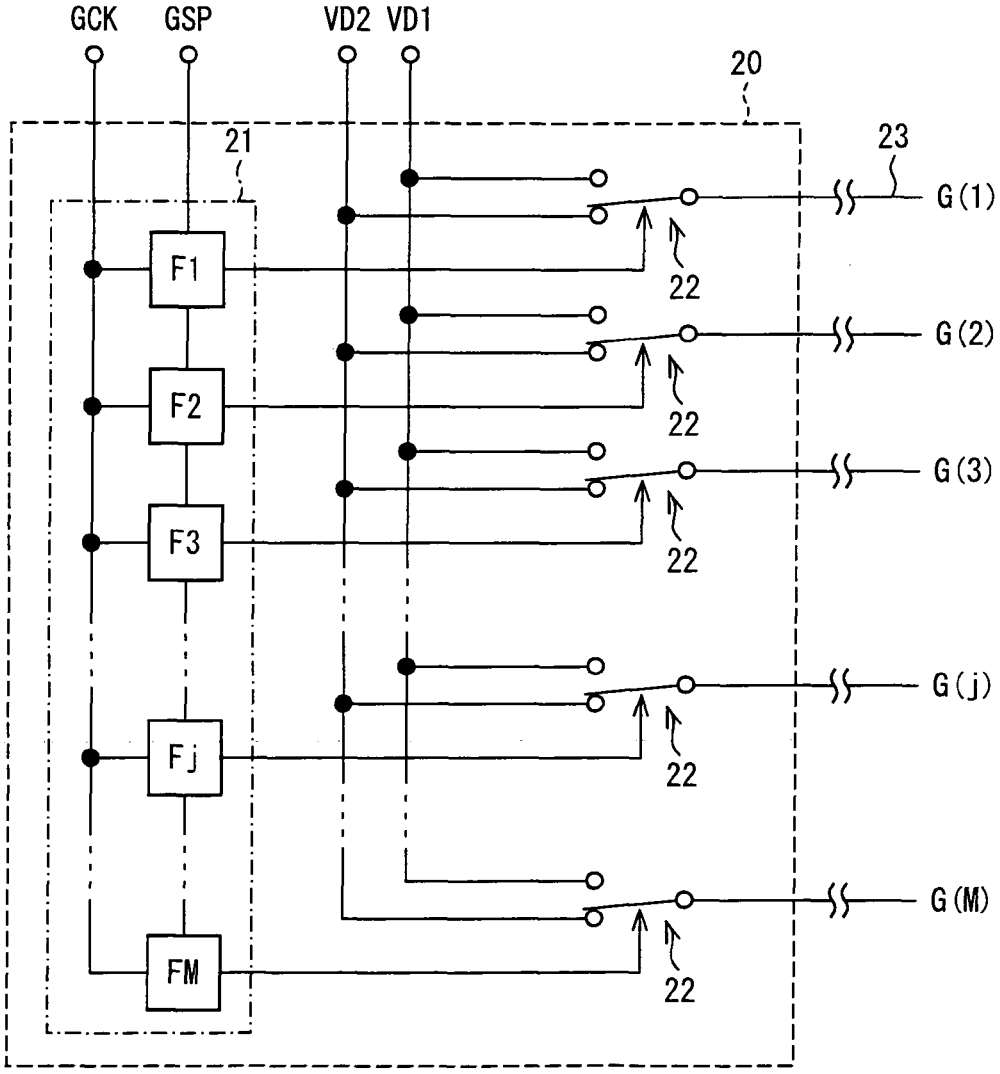
FIG. 4 is a circuit block diagram showing an example of a configuration of a gate driver in the display apparatus shown in FIG. 2.

FIG. 4 shows an example of a configuration of a gate driver 20 for generating a signal whose waveform has a slope period Tslope. The configuration of the gate driver 20 can be employed in the upper gate drivers 5*a* and the lower gate drivers 6*a*.

The gate driver 20 includes a shift register 21 and switches 22. The shift register 21 includes flip flops F1 through FM, which are connected with one another in cascade. A gate start pulse GSP supplied to the flip flop F1 (which is an upstream one of the flip flops F1 through FM) is sequentially supplied to downstream ones of the flip flops F1 through FM at timings of a gate clock signal GCK. On reception of the gate start pulse GSP, each of the flip flops F1 through FM supplies a switchover signal to corresponding one of the switches 22. Each switch 22 operates so as to switch a terminal being connected to a scanning signal line (corresponding one of scanning signal lines G(1), G(2), . . . , G(j), . . . , and G(M)) between a terminal via which a voltage VD1 is supplied and another terminal via which a voltage VD 2 is supplied.

Figure 6:
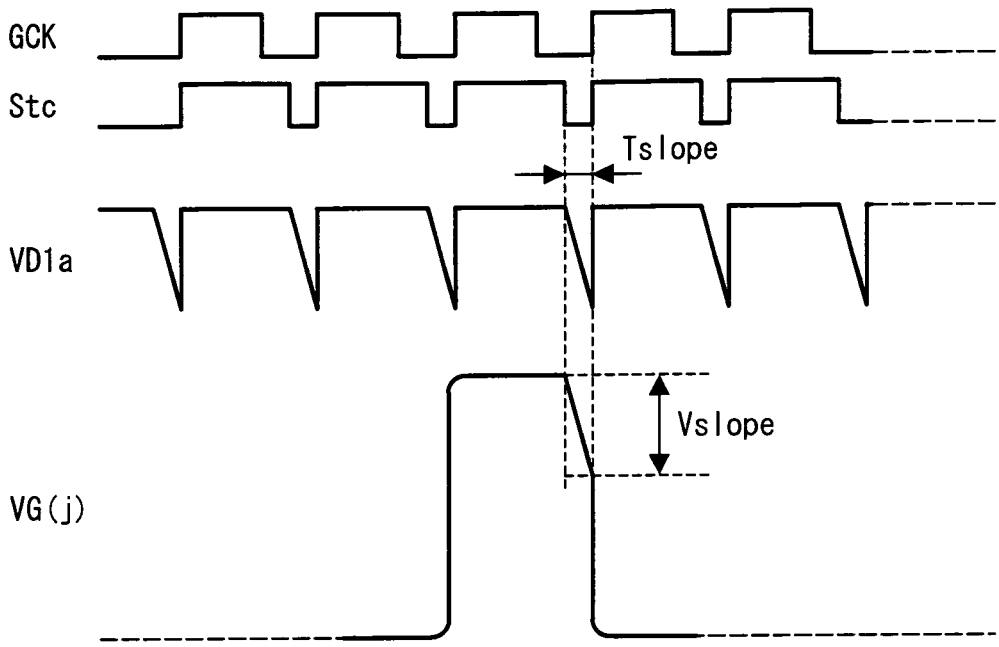
FIG. 6 is a waveform chart showing a waveform of the voltage that is generated in the circuit shown in each of FIGS. 4 and 5.

For example, the voltage VD 1 is a voltage whose waveform is shown by VD 1*a* in FIG. 6, and the voltage VD 2 is the gate-low voltage Vgl. A voltage to be supplied via the terminal connected to the scanning signal line is switched between the voltage VD 1 (VD 1*a*) and the gate-low voltage Vgl by the switch 22, such that an output to each one of the scanning signal lines G(1), G(2), . . . , G(j), . . . , and G(M) has a waveform as shown by VG(j) in FIG. 6.

Figure 5:
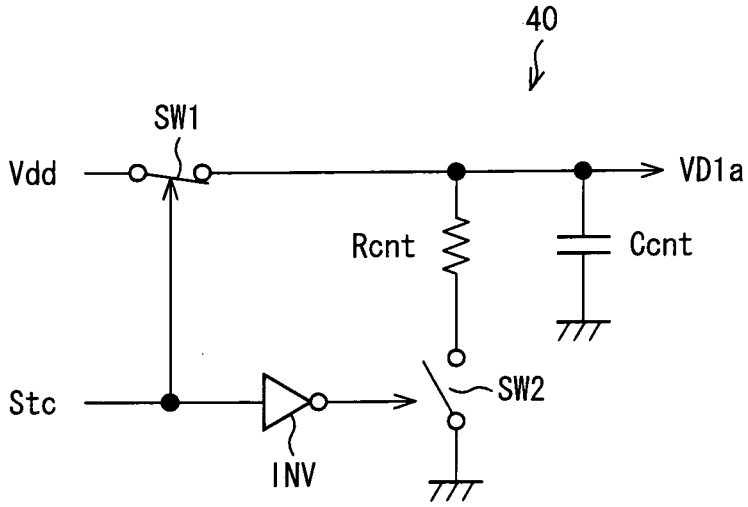
FIG. 5 is a circuit diagram showing an example of a configuration of a circuit for generating a voltage which is supplied to the gate driver shown in FIG. 4.

FIG. 5 shows an example of a configuration of a circuit 40 for generating the voltage VD 1*a*. In the circuit 40, a capacitor Ccnt is alternatively and repeatedly charged by a power supply Vdd and discharged via a resistor Rcnt, such that a voltage of the capacitor Ccnt is supplied, as the voltage VD 1*a*, from the circuit 40. The capacitor Ccnt is provided between a ground GND and the terminal via which the voltage VD 1*a* is externally outputted. The capacitor Ccnt has one end, which is closer to the terminal and serves as a charging node. A switch SW 1 is provided between the power supply Vdd and the charging node of the capacitor Ccnt. The resistor Rcnt is connected in parallel with the capacitor Ccnt at the charging node of the capacitor Ccnt. A switch SW 2 is provided between one end of the resistor Rcnt and the grand GND. While the capacitor Ccnt is being electrically charged, (i) the switch SW 1 is turned ON by a signal Stc, and (ii) the switch SW 2 is turned OFF by an inversion signal of the signal Stc which is supplied via an inverter INV. While the capacitor Ccnt is being electrically discharged via the resistor Rcnt, the voltage of the capacitor Ccnt is decreased in accordance with a time constant determined based on the capacitor Ccnt and the resistor Rcnt. As shown in FIG. 6, the signal Stc is shifted to High at the same cycle and the same timing as the gate clock signal GCK, and shifted to Low during the slope period Tslope which comes last within each cycle.

Thus, as shown in FIG. 6, during one horizontal period during which a scanning signal line G(j) (which is the jth one of the scanning signal line G(1) to G(M)) is selected, a switch 22 shown in FIG. 5 connects the scanning signal line G(j) to a terminal via which the voltage VD 1 is supplied. Accordingly, an output to the scanning signal line G(j) has a waveform in which a voltage is (i) shifted from the gate-low voltage Vgl to the gate-high Vgh, (ii) declined, during a slope period Tslope, from the gate-high voltage Vgh by a degree shown by a voltage Vslope, and (iii) shifted to the gate-low voltage Vgl (see waveform of a scanning signal VG(j) shown in FIG. 6). During a period other than the period during which the scanning signal line G(j) is selected, the switch 22 connects the scanning signal line G(j) to a terminal via which the voltage VD 2 is supplied, such that the scanning signal line G(j) is kept to be supplied with the gate-low voltage Vgl.

A pulse of each scanning signal VG thus has a slope period Tslope. Therefore, even if there is a factor causing signal delay distribution on a scanning signal V which is varied from one point on a scanning signal line G to another point on the scanning signal line G, a waveform of the scanning signal VG can remain the same throughout a scanning line G. The signal delay distribution on the scanning signal line G is particularly problematic to a display apparatus including a large screen often having a plurality of regions. Thus, to such display apparatus, an effect that prevents a difference in brightness among the plurality of regions by varying pulse periods of scanning signals VG can be more effective.

Figure 7:
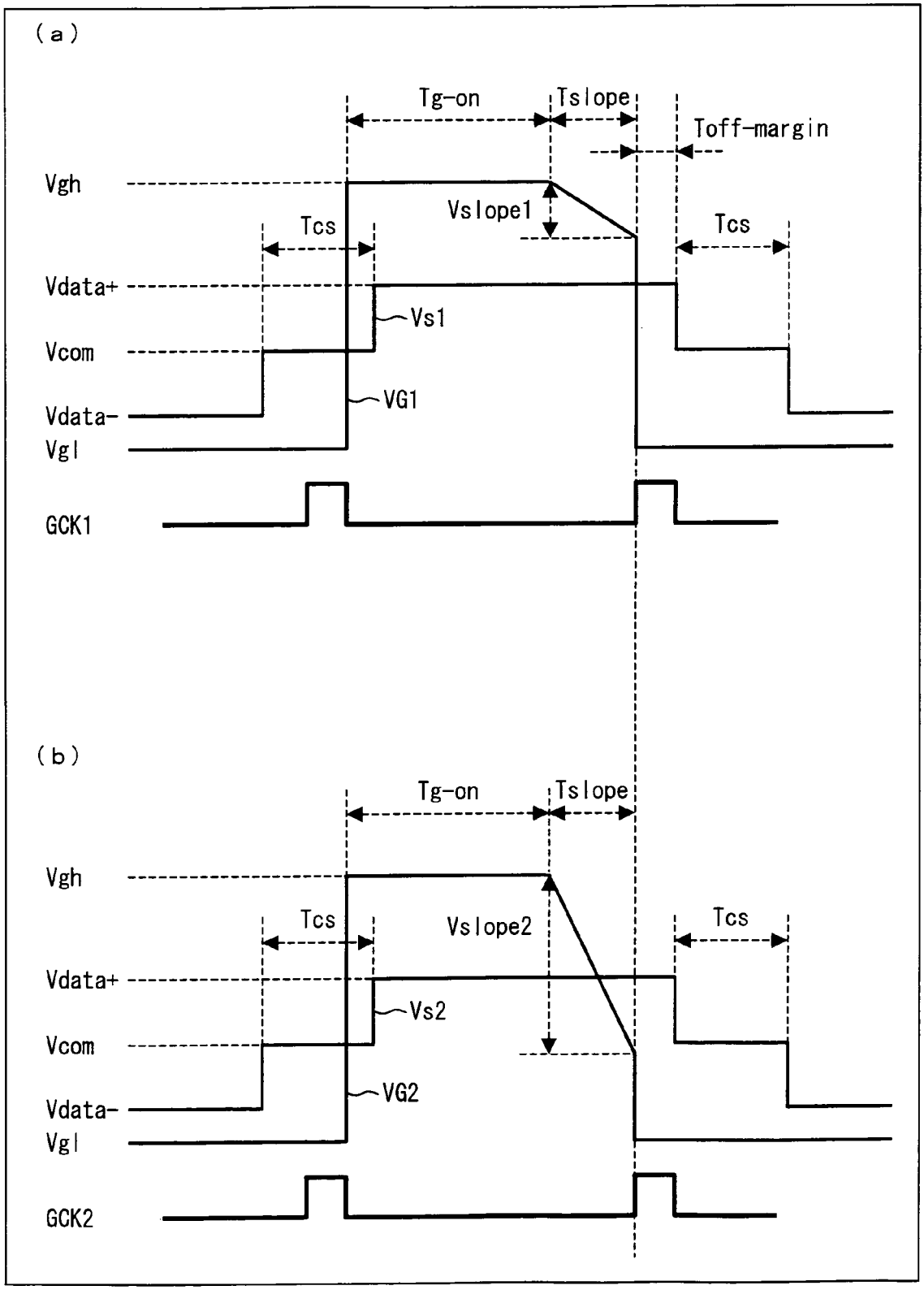
FIGS. 7 (*a*) and (*b*) of FIG. 7 are waveform charts each showing waveforms of voltages in a display apparatus in accordance with a modified example of the present invention.
Figure 8:
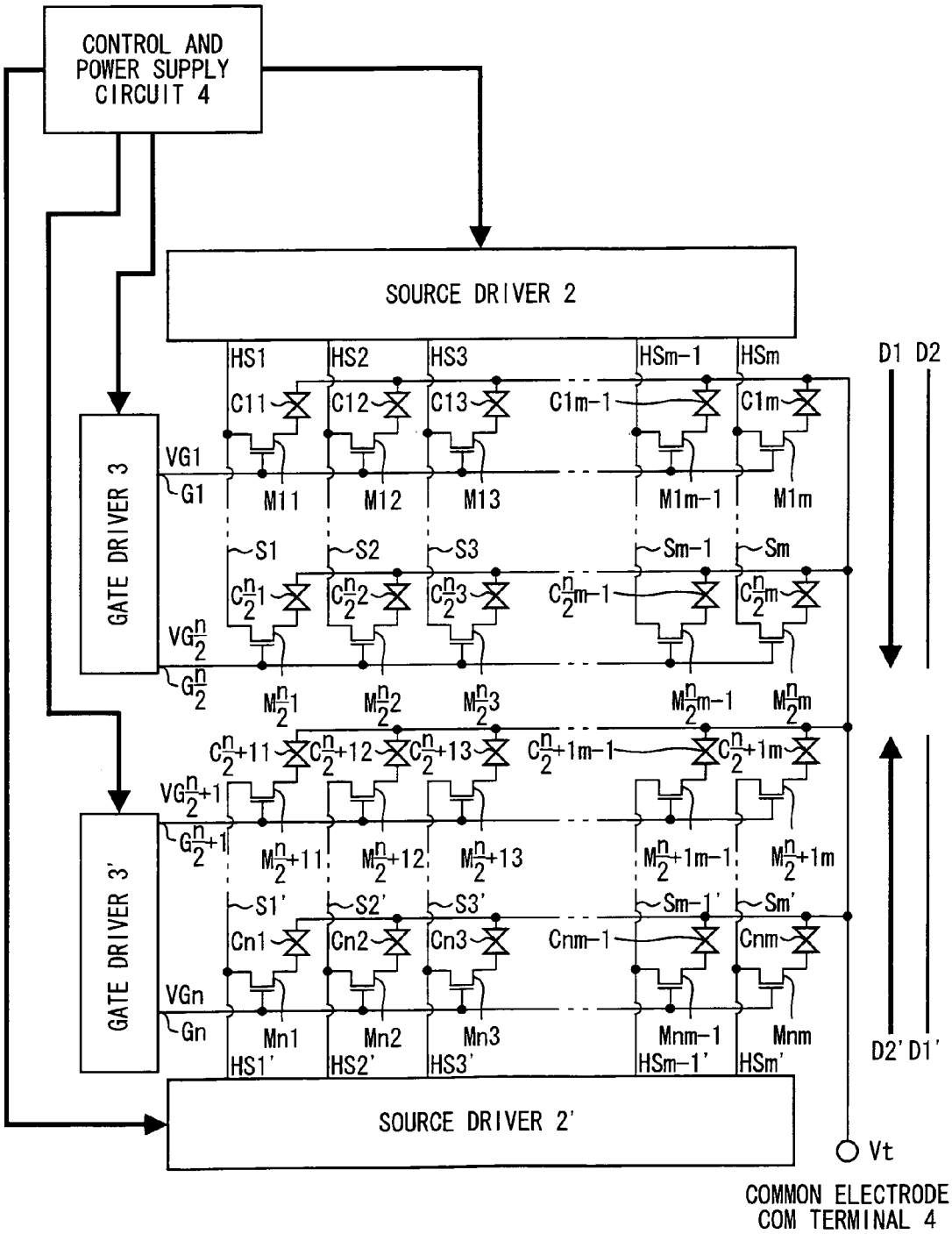
FIG. 8 is a circuit block diagram dealing with a conventional technique, showing a configuration of a display apparatus with a screen having an upper region and a lower region.

With reference to (*a*) and (*b*) of FIG. 7 and in relation with setting of the slope periods, the following describes another method for setting a brightness of the upper region 10*a* to the same brightness level as the lower region 10*b*.

In (*a*) of FIG. 7, it is shown that a gate clock signal GCK 1 for the upper region 10*a* has the same timing as the gate clock signal GCK 1 shown in (*a*) FIG. 1, and that a scanning signal VG 1 for the upper region 10*a* has the same waveform as the scanning signal VG 1 shown in (*a*) of FIG. 1. In (*b*) of FIG. 7, it is shown that a gate clock signal GCK 2 for the lower region 10*b* has the same timing as the gate clock signal GCK 1, and that a scanning signal VG 2 for the lower region 10*b* has the same slope period as the scanning signal VG 1 and declines at a greater slope than the scanning signal VG 1. That is, Vslope 2 by which the scanning signal VG 2 declines during the slope period Tslope is greater than Vslope 1 by which the scanning signal VG 1 declines during the slope period Tslope. The following measures should be taken such that a slope with which a scanning signal VG declines during a slope period Tslope becomes greater. Specifically, a time constant should be reduced by, for example, reducing resistance value of the resistor Rcnt shown in FIG. 5.

In the above case, the slope during the slope period Tslope is set so that a scanning signal has a voltage, at an end of the slope period Tslope, which is higher than a threshold voltage level of a TFT 11. Accordingly, the TFT 11 is kept ON at the end of the slope period Tslope, and then turned OFF in process of the scanning signal declining to the gate-low voltage Vgl. By setting greater Vslope 2, it is possible that while a conductance of the TFT 11 (i.e., an amount of a drain current from the TFT 11) during the slope period Tslope is reduced, the period during which a pixel PIX is selected be ended in process of electrical charging of the pixel PIX.

Alternatively, Vslope 2 can be set so that the scanning signal VG 2 declines to the threshold voltage level of the TFT 11 in middle of the slope period Tslope. By this, the TFT 11 in the pixel PIX of the lower region 10*b* can be turned OFF in middle of the slope period Tslope of the scanning signal VG 2. Thus, a period during which the pixel PIX of the lower region 10*b* is selected is shorter, as compared with a pixel PIX of the upper region 10*a* that is electrically charged until an end of a slope period Tslope. That is, a charging rate of the pixel PIX of the lower region 10*b* is reduced more than the pixel PIX of the upper region 10*a*. Accordingly, by setting Vslope 2 appropriately, it is possible to set a brightness in the pixel PIX of the upper region 10*a* to the same brightness level as a brightness in the pixel PIX of the lower region 10*b*.

In a case where Vslope 2 is set by adjusting a resistance value of a resistor Rcnt shown in FIG. 5, for example, the following measures are taken. Specifically, each gate driver is configured so as to include a circuit shown in FIG. 5 in advance, and a resistor Rcnt on the circuit of each gate driver is trimmed during producing of a panel.

The present embodiment is thus described hereinabove.

In the embodiment described above, the screen has two regions. However, the present invention is not limited to this. In general, the screen can have a plurality of regions. For example, the display apparatus 1 shown in FIG. 2 can further include upper gate drivers and lower gate drivers so that the display region 10 is arranged between (i) the upper gate drivers 5*a* and the lower gate drivers 6*a* and (ii) the upper gate drivers and the lower gate drivers. The display region 10 arranged in the way has four regions. Gate clock signals are individually supplied to the upper gate drivers 5*a* and the lower gate drivers 6*a*. Alternatively, it can be configured such that only some of the plurality of regions are supplied with corresponding gate clock signals which have respective different waveforms as shown in (*a*) and (*b*) of FIG. 1 or as shown in (*a*) and (*b*) of FIG. 7.

The present invention can alternatively be configured such that each gate clock signal has a negative pulse. In that case, logic of the positive pulse discussed in the earlier description is inverted.

Further, the present invention can alternatively be configured such that each scanning signal has a negative pulse. In that case, pixels are selected by use of such scanning signals.

According to the embodiment thus described, the gate clock signal GCK 1 shown in (*a*) of FIG. 1 and the gate clock signal GCK 2 shown in (*b*) of FIG. 1 are identical with each other in terms of clock pulse-end timing, but different from each other in terms of pulse width. However, the present invention can alternatively be configured such that gate clock signals GCK 1 and GCK 2 are identical with each other in terms of clock pulse-start timing, but different from each other in terms of pulse width.

Further; the present invention can alternatively be configured such that no charge sharing is carried out.

The present invention can be directed not only to a display apparatus whose display device is a liquid crystal device, but also to all types of an active matrix display apparatus such as an EL display apparatus.

The present invention is not limited to the description of the embodiment above, but may be altered by a skilled person within the scope of the claims. An embodiment based on a proper combination of technical means altered as appropriate within the scope of the claims is encompassed in the technical scope of the present invention.

As described so far, the display apparatus of the present invention is configured so that corresponding ones of the gate clock signals for some of the plurality of regions have respective different pulse widths.

By this, it is possible to realize a display apparatus including a screen having a plurality of regions, in which display apparatus a difference in brightness among the plurality of regions can be prevented.

As described so far, the method according to the present invention for driving a display apparatus is arranged such that the scanning lines are driven in each of the plurality of regions so that corresponding ones of the gate clock signals for some of the plurality of regions have different pulse widths.

By this, it is possible to realize a method for driving display apparatus including a screen having a plurality of regions, by which method a difference in brightness among the plurality of regions can be prevented.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention can be suitably used in a liquid crystal display device.

The invention claimed is:

1. An active matrix display apparatus comprising:

a screen having a plurality of regions each provided with a gate driver, in each of which plurality of regions scanning lines are driven so as to be sequentially selected by use of timing of a gate clock signal individually supplied to the gate driver, wherein:

corresponding ones of the gate clock signals for some of the plurality of regions have respective different pulse widths, and the gate driver generates a scanning signal so that the scanning signal has a same period between pulse-start timing and pulse-end timing as a period of the gate clock signal between pulse-end timing of a pulse and pulse-start timing of a following pulse.

2. The active matrix display apparatus as set forth in claim 1, wherein:

the corresponding ones of the gate clock signals are identical in terms of pulse-end timing or pulse-start timing.

3. The active matrix display apparatus as set forth in claim 1, wherein:

charge sharing between data signal lines is carried out during a horizontal blanking period.

4. A method for driving an active matrix display apparatus including a screen having a plurality of regions each provided with a gate driver, the method comprising:

driving scanning lines in each of the plurality of regions so that the scanning lines are sequentially selected by use of timing of a gate clock signal individually supplied to the gate driver, wherein:

the scanning lines are driven in each of the plurality of regions so that corresponding ones of the gate clock signals for some of the plurality of regions have different pulse widths, and the gate driver generates a scanning signal so that the scanning signal has a same period between pulse-start timing and pulse-end timing as a period of the gate clock signal between pulse-end timing and pulse-start timing.

5. The method as set forth in claim 4, wherein:

the corresponding ones of the gate clock signals are identical in terms of pulse-end timing or pulse-start timing.

6. The method as set forth in claim 4, wherein:

charge sharing between data signal lines is carried out during a horizontal blanking period.

* * * * *